United States Patent [19]

Fujikawa et al.

[11] Patent Number: 4,716,861

[45] Date of Patent: Jan. 5, 1988

[54] 4-CYCLE ENGINE

[75] Inventors: Tetsuzo Fujikawa, Kobe; Shinichi Tamba, Kakogawa; Noriyuki Ueki, Akashi, all of Japan

[73] Assignee: Kawasaki Jukogyo Kabushiki Kaisha, Japan

[21] Appl. No.: 858,048

[22] Filed: May 1, 1986

[30] Foreign Application Priority Data

May 1, 1985 [JP] Japan ..... 60-94744

[51] Int. Cl.[4] ..... F01L 1/10; F01L 1/26

[52] U.S. Cl. ..... 123/90.2; 123/90.23

[58] Field of Search ..... 123/90.2, 90.22, 90.23, 123/90.18

[56] References Cited

U.S. PATENT DOCUMENTS 979,794 12/1910 Peteler ..... 123/90.2
1,174,748 3/1916 Marcil ..... 123/90.2
1,688,164 10/1928 Tarrant ..... 123/90.18
1,708,749 4/1929 Adam ..... 123/90.23
3,481,314 12/1969 Grenn ..... 123/90.18

*Primary Examiner*—Ira S. Lazarus

[57] ABSTRACT

A 4-cycle engine including a crankshaft connected to a piston and supported at opposite ends by a crankcase for rotation. The crankshaft is formed at one of its two output shaft sections with a groove extending peripherally along the outer peripheral surface of one output shaft section substantially in the form of a endless loop having a cross point. A plurality of followers engaged in the groove have their movements transmitted, through respective linkages, to an exhaust valve and a suction valve respectively. A governor device is located at the other output shaft section and operative to actuate an engine rpm. controller depending on the speed of rotation of the crankshaft.

2 Claims, 5 Drawing Figures

4-CYCLE ENGINE

FIELD OF THE INVENTION AND RELATED ART STATEMENT

This invention relates to a 4-cycle general purpose engine which is small in size and simple in construction.

Generally, the requirements that should be met by a 4-cycle general purpose engine of a small size are that it is low in cost, light in weight and compact in overall size.

One type of 4-cycle general purpose engine developed to meet these requirements is disclosed in Japanese Laid-Open Patent Application No. SHO 59-150912, for example.

The 4-cycle engine disclosed in this document has guide portions formed in two positions on the output shaft sections of the crankshaft, each of the guide portions being provided with a linkage so as to open and close one of a suction valve and an exhaust valve separately while doing without a cam shaft, to obtain a compact size of the engine.

The problem encountered in this engine is that, since the guide portions are formed in two positions on the output shaft sections, the overall size of the engine is increased due to an increase in the length of the output shaft sections.

This problem becomes serious particularly when governor means for controlling the rpm. of the engine to keep same constant is mounted on the output-shaft sections of the crankshaft.

OBJECT AND SUMMARY OF THE INVENTION

This invention has as its object the provision of a 4-cycle engine in which suction valves and exhaust valves are opened and closed without using a cam shaft, and an overall compact size can be obtained even if governor means is mounted to keep the rpm. of the engine constant.

The outstanding characteristics of the invention enabling the aforesaid object to be accomplished include a valve drive located at one end of a crank-shaft of the type supported at both ends and comprising a guide groove formed at one of a plurality of output shaft sections of the crank-shaft and extending peripherally along its outer peripheral surface in the form of a endless loop having a cross point and a plurality of linkages cooperating with the guide groove for opening and closing a suction valve and an exhaust valve respectively, and governor means located at an opposite end of the crank-shaft to act in conjunction with an engine rpm. controller depending on the speed of rotation of the crank-shaft.

The arrangement whereby the valve drive is located at one side of the crank-shaft and the governor means at the opposite side thereof according to the invention enables the axial length of the crank-shaft to be reduced, thereby permitting an overall compact size to be obtained in a 4-cycle general purpose engine.

DESCRIPTION OF THE PREFERRED EMBODIMENT

A preferred embodiment of the small, 4-cycle general purpose engine of the side valves type in conformity with the invention will be described by referring to the accompanying drawings.

Figure 1:
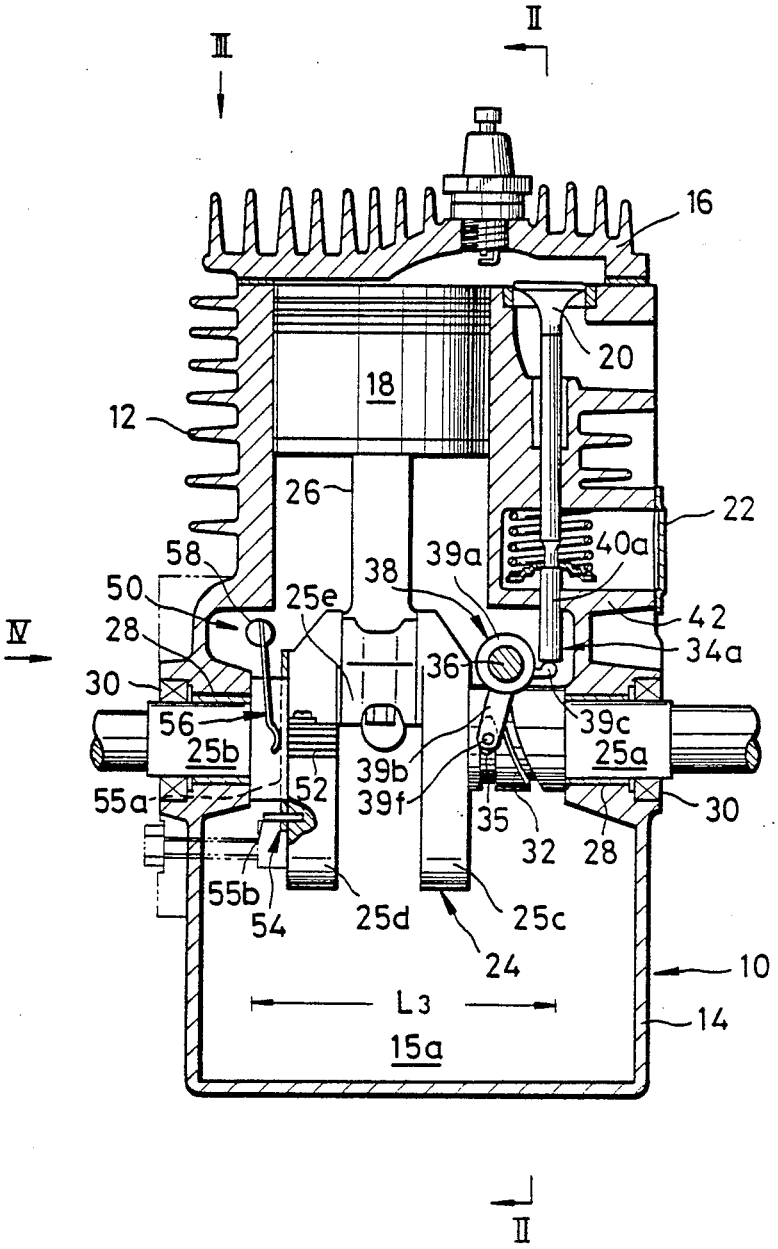
FIG. 1 is a vertical sectional view of the 4-cycle engine comprising one embodiment of the invention.

Referring to FIG. 1, an engine block 10 has formed integrally therewith a cylinder 12 and a crank-case 14. A cylinder head 16 is located on top of the cylinder 12 which has a piston 18 slidably fitted therein.

An exhaust valve 20 is located near one side of the cylinder 12, and a suction valve 21 (see FIG. 2) is located adjacent the exhaust valve 20 and spaced apart therefrom in a direction perpendicular to the plane of FIG. 1. A side cover 22 is detachably attached to the one side of the cylinder 12.

The crank-case 14 supports therein for rotation a crank-shaft 24 of the type supported at both ends and has an oil pan 15*a* formed at its bottom portion. The crank-shaft 24 which includes output shaft sections 25*a* and 25*b*, crank webs 25*c* and 25*d* and a crank pin 25*e* is formed by forging as a unitary structure. A connecting rod 26 connects the crank pin 25*e* to the piston 18. The output shaft sections 25*a* and 25*b* are each journalled at an end portion thereof by a metal bearing 28 supported by one of opposite sides of the crank-case 14. The numeral 30 designates an oil seal.

The output shaft section 25*a* on the right side in FIG. 1 is formed with a guide groove (guide portion) 32 in one position thereof. A plurality of linkages 34*a* and 34*b* (see FIG. 2) presently to be described in detail cooperate with the guide groove 32. The output shaft section 25*b* on the left side of FIG. 1 supports thereon governor means 50 subsequently to be described in detail.

Figure 2:
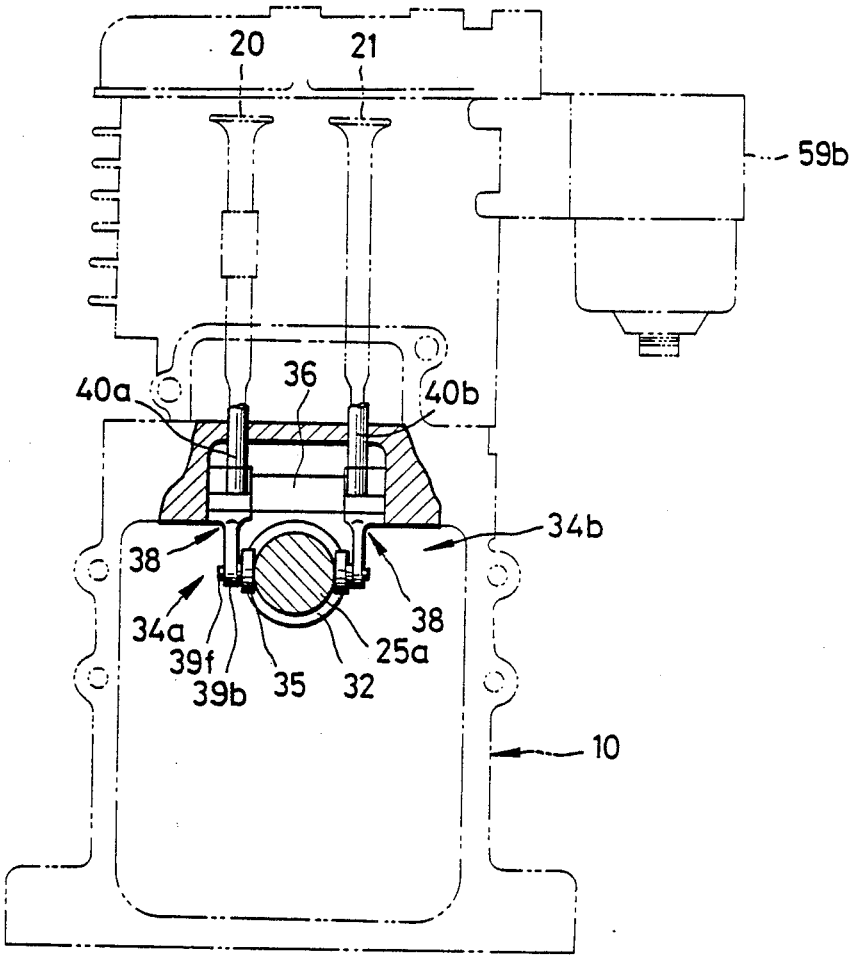
FIG. 2 is a sectional view taken along the line II—II in FIG. 1.
Figure 3:
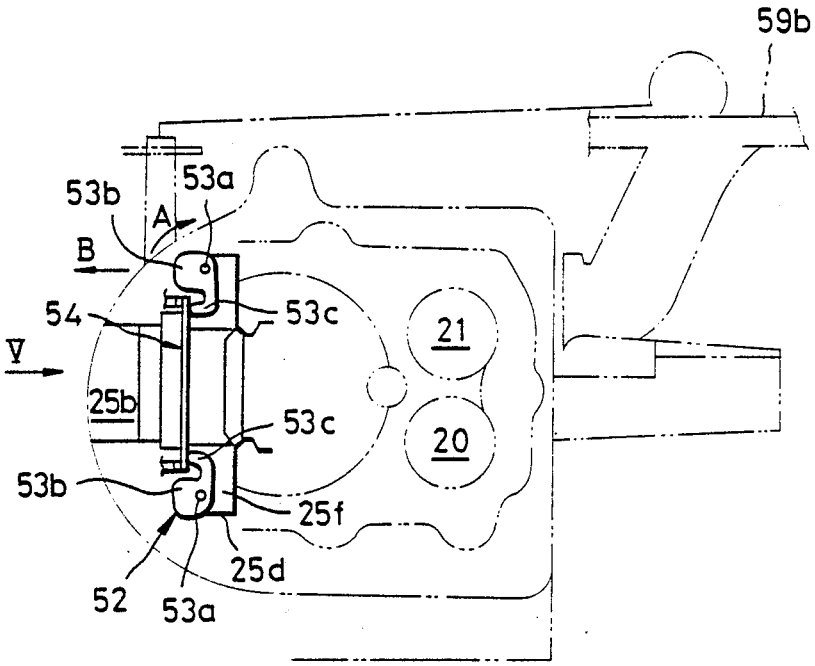
FIG. 3 is a view as seen in the direction of an arrow III in FIG. 1.

The guide groove 32 which is formed substantially square in cross section extends peripherally two times around the output shaft 25*a* and forms a endless loop having a cross point. As shown in FIG. 2, the guide groove 32 is concentrical with the output shaft section 25*a*.

A linkage 34*a* for operating the exhaust valve 20 and a linkage 34*b* for operating the suction valve 21 are located substantially on opposite sides of the output shaft section 25*a* and face each other as shown in FIG. 2.

The linkages 34*a* and 34*b* each comprise a bell crank 38. The bell cranks 38 of the linkages 34*a* and 34*b* are each supported for rotation by one of opposite end portions of a shaft 36 secured to the crank-case 14. The shaft 36 is located above the output shaft section 25*a* and extends in a direction perpendicular to the center axis of the output shaft section 25*a*.

As shown in FIG. 1, the bell cranks 38 are each formed by casting as a unitary structure and comprise a boss 39*a* fitted over the shaft 36, an arm portion 36*b* and a push-up portion 39*c*. The arm portion 39*b* extends from the lower portion of the boss 39*a* to one side of the output shaft section 25*a*. The push-up portion 39*c* extends radially outwardly from the boss 39*a* to the lower end of a tappet 40*a* for the exhaust valve 20 with which it is kept in pressing contact. The tappet 40*a* extends vertically through a support wall of the crank-case 14 for sliding movement.

Supported at the lower end of the arm portion 39*b* through a shaft 39*f* is a follower 35 which is fitted in the guide groove 32. The follower 35 moves axially of the output shaft section 25*a* as the latter rotates so as to move the bell crank 38 in swinging movement about the shaft 36. The shaft 39*f* of the follower 35 is rotatably fitted in the lower end portion of the arm portion 39*b*.

The follower 35 is substantially fusiform as shown in FIG. 1 and smoothly tapers from its central portion toward its opposite ends. The follower 35 has a length which is greater than the length of sections of the guide groove 32 which cross each other.

Thus, the risk that the follower 35 might fail to follow its predetermined course through the sections of the guide groove 32 which cross each other and might misoperate is eliminated not only when the crank-shaft 24 rotates in the normal direction but also when it is rotated in the reverse direction at engine startup.

The bell crank 38 of the linkage 34*b* is identical with that of the linkage 34*a*, and the push-up portion 39*c* thereof is kept in pressing contact with the lower end of a tappet 40*b* for the suction valve 21.

The guide groove 32 and linkages 34*a* and 34*b* constitute a valve drive.

Referring to FIG. 1, the governor means 50 comprises weights 52, a slider 54 and a forked arm 56. Each weight 52 which is moved by centrifugal forces produced by the rotation of the crank-shaft 24 is pivotally supported through a pin 53*a* by a stepped portion 25*f* of the crank web 25*d*. Each weight 52 is composed of a main body 53*b* and an arm 53*c*. When the weights 52 are moved in the direction of an arrow A by the centrifugal forces produced by the crank-shaft 24, the arms 53*c* move the slider 54 in sliding movement in the direction of an arrow B.

The slider 54 comprises a ring plate 55*a* and openings for guiding each pin 55*b* as shown in FIG. 1. The pin 55*b* is press-fitted to the crank web 25*d*, and the forked arm 56 is maintained in pressing engagement with an end face of the ring plate 55*a* so as to urge the slider 54 to move in a direction opposite the direction indicated by the arrow B.

Figure 4:
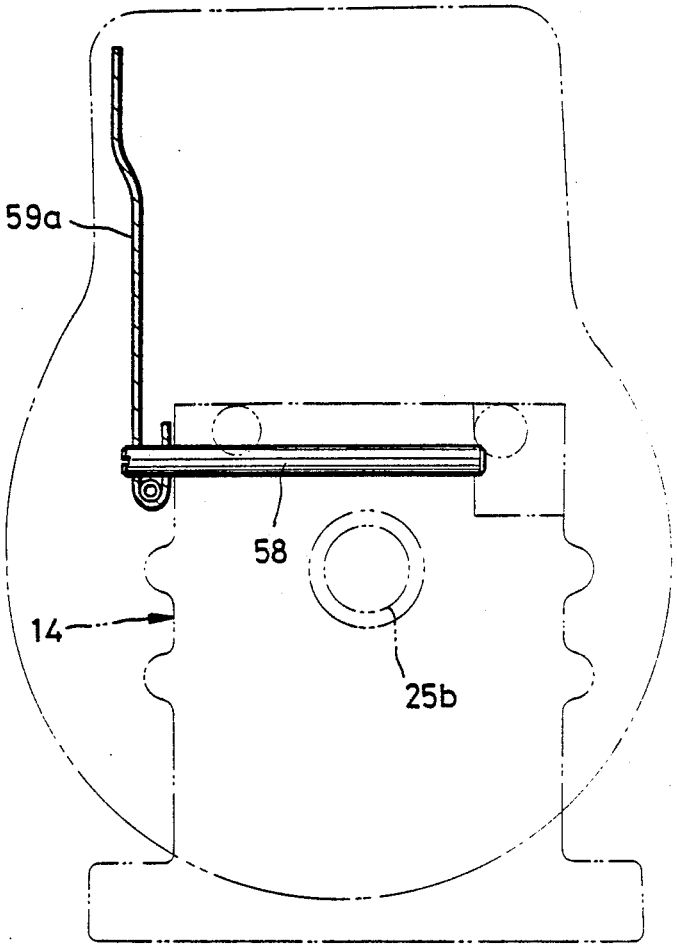
FIG. 4 is a view as seen in the direction of an arrow IV in FIG. 1.

The forked arm 56 is secured at its upper end portion to a shaft 58 so that they can move as a unit. As shown in FIG. 4, the shaft 58 is supported by the crank-case 14 in such a manner that its left end portion extends out of the crank-case 14 and supports an arm 59*a* which is connected to a carburetor (an engine rpm. control means) 59*b* shown in FIG. 2.

Figure 5:
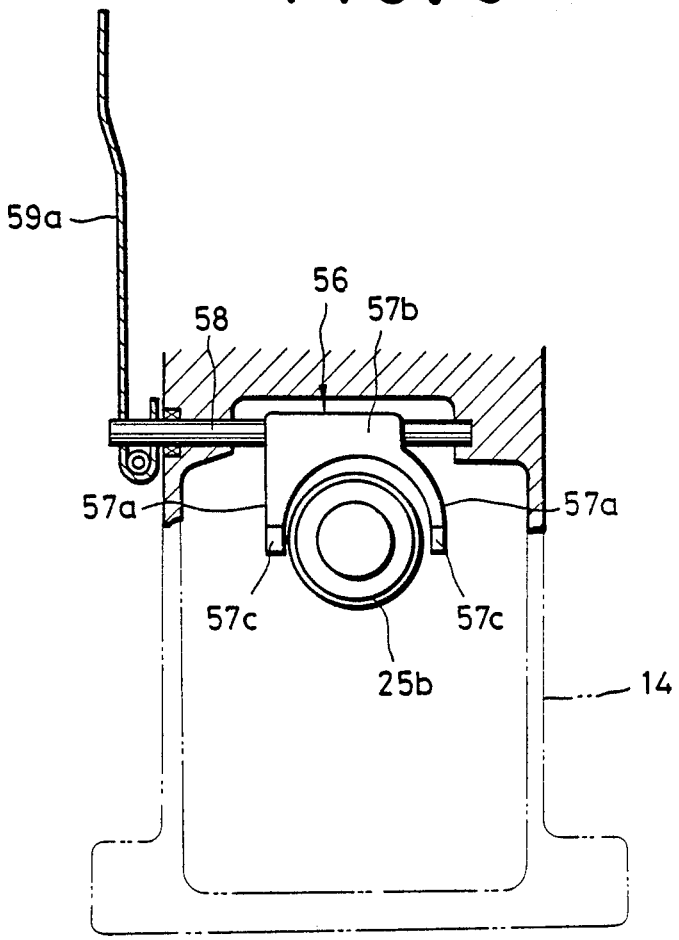
FIG. 5 is a view as seen in the direction of an arrow V in FIG. 3.

Referring to FIG. 5, the forked arm 56 comprises two arm portions 57*a* arranged substantially in the form of a letter U in an inverted position to straddle the output shaft section 25*b*. The arm portions 57*a* each have at its lower end a pressing portion 57*c* which is maintained in pressing engagement with an end face of the ring plate 55*a*. The forked arm 56 is secured at a boss 57*b* to the shaft 58 for rotation as a unit.

In operation, as the crank-shaft 24 rotates, the follower 35 of the linkage 34*a* for operating the exhaust valve 20 is guided by the guide groove 32, for example, and moves through the entire guide groove 32 in sliding movement while the crank-shaft 24 makes two complete revolutions, to cause the bell crank 38 once to swing to and for about the shaft 36.

Swing of the bell crank 38 causes the push-up portion 39*c* also to swing about the shaft 36, so that the tappet 40*a* maintained at its lower end in contact with the push-up portion 39*c* is lifted by the latter a predetermined amount to open the exhaust valve 20, for example.

The linkage 34*b* for operating the suction valve 21 is located at a side of the output shaft section 25*a* disposed substantially opposite the side at which the linkage 34*a* for the exhaust valve 20 is located. Thus, even if the followers 39*e* of the two linkages 34*a* and 34*b* were in sliding engagement in the same guide groove 32, they have a phase difference of 180 degrees, so that the operation of opening the exhaust valve 21 is not interfered with and the linkage 34*a* functions to open (or close) the exhaust valve 20 with correct timing.

The metal bearings 28, guide groove 32 and followers 35 are lubricated by splash lubrication.

The followers 35 of the linkages 34*a* and 34*b* are fitted in and guided by the common guide groove 32. This arrangement allows the exhaust valve 20 and suction valve 21 to be opened and closed by the operations of the linkages 34*a* and 34*b* which are linked to each other through the common guide groove 32. This eliminates the need to provide two guides, one for the exhaust valve 20 and the other for the suction valve 20, with a result that the length $L_3$ (see FIG. 1) of the crank-shaft 24 in the axial direction can be reduced.

This makes the crank-case 14 compact in size, and it is also possible to obtain an overall compact size in a 4-cycle engine which uses the crank-case 14 of this construction.

The guide groove 32 can be readily formed by machining because what is essential is to form the guide groove 32 concentrically with the output shaft section 25*a*.

The use of the crank-case 14 of the aforesaid construction enables the exhaust valve 20 and suction valve 21 to be located adjacent each other and oriented in a direction perpendicular to the center axis of the exhaust valve 21, thereby permitting the exhaust valve 20 and suction valve 21 to be disposed adjacent one side of the cylinder 12 in what is usually referred to as an L-type arrangement.

The governor means 50 is located at the output shaft section 25*b* located on a side of the crank-case 14 opposite the side thereof on which the linkages 34*a* and 34*b* are located at the output shaft section 25*a*. This enables the length $L_3$ to be further reduced. The linkages 34*a* and 34*b* and governor means 50 are located in a dead space in the crank-case 14, thereby further reducing the size of the crank-case 14.

The weights 52 of the governor means 50 are directly secured to the crank web 25*d*. This eliminates the need to use a drive gear used in the prior art, thereby simplifying the construction of the governor means 50 and reducing the noise level. The distance between the governor means 50 and crank web 25*d* is reduced, thereby increasing the response of the governor means 50.

From the foregoing description, it will be appreciated that the outstanding characteristics of the invention include a valve drive located at one end of a crank-shaft of the type supported at opposite ends in a 4-cycle engine, and governor means located at an opposite end of the crank-shaft. The valve drive comprises a guide groove formed at one output shaft section of the crank-shaft substantially in the form of a endless loop having a cross point, and a plurality of linkages adapted to cooperate with the guide groove to operate an exhaust valve and a suction valve respectively, and the governor means acting in conjunction with an engine rpm.

controller depending on the speed of rotation of the crank-shaft.

The invention offers the following advantages. The provision of the linkages 34a and 34b (forming a part of the valve drive) at the output shaft section 25a at one side of the crank-case 14 and the governor means 50 at the output shaft section 25b at an opposite side of the crank-case 14 enables the governor means 50 to be disposed in the crank-case 14 while reducing the length $L_3$ of the crank-shaft 24.

This eliminates the need to use gears constituting a source of noises in an engine, thereby markedly reducing the noise level of the engine.

In addition to the length $L_3$ of the crank-shaft 24 being reduced, a dead space in the crank-case 14 can be utilized for mounting the linkages 34a and 34b and governor means 50. This is conducive to a reduction in the size of the crank-case 14.

The invention is not limited to the specific constructional form of the governor means 50 shown and described hereinabove, and any other constructional form may be used.

Ths invention may be incorporated in a 4-cycle engine in which the exhaust and suction valves are overhead valves, and the engine rpm. controller is not the carburetor 59b but an ignition device which adjusts ignition timing.

What is claimed is:

1. A 4-cycle engine comprising:

a crank-case;

a cylinder formed integrally with said crank-case to provide a unitary structure;

a piston fitted in said cylinder for reciprocatory movement;

a crank-shaft connected to said piston and supported at opposite ends in said crank-case for rotation, said crank-shaft including two output shaft sections oriented in opposite directions;

a guide groove formed at one of said two output shaft sections, said guide groove extending twice around the one output shaft section peripherally along an outer peripheral surface of said output shaft section in the form of an only single endless loop with a cross point;

a plurality of followers engaged in said guide groove, said plurality of followers being located in positions substantially on opposite sides of said one output shaft section in positions having a phase difference of substantially 180 degrees;

a plurality of linkages each connected to one of said plurality of followers through a bell crank, one of said linkages being linked to an exhaust valve and the other linkage being linked to a suction valve to transmit the movements of the followers to the respective valves to open and close same; and governor means mounted on the other output shaft section innerside of a bearing portion thereof.

2. A 4-cycle engine as claimed in claim 1, wherein said governor means comprises a plurality of weights rotatably supported by one of a plurality of crank webs, a slider slidably supported by said the other output shaft section, and a forked arm maintained in pressing engagement with said slider, the movements of said weights being transmitted to said slider and the movement of said forked arm being transmitted to means for controlling engine rpm.

* * * * *